US006443569B1

(12) United States Patent
Mheidle et al.

(10) Patent No.: US 6,443,569 B1
(45) Date of Patent: Sep. 3, 2002

(54) METHOD FOR PRINTING FIBROUS TEXTILE MATERIALS ACCORDING TO THE INK JET PRINTING TECHNIQUE

(75) Inventors: Mickael Mheidle, Sausheim; Bénédicte Galéa, Rixheim, both of (FR)

(73) Assignee: Ciba Specialty Chemicals Corporation, Tarrytown, NY (US)

( * ) Notice: Subject to any disclaimer, the term of this patent is extended or adjusted under 35 U.S.C. 154(b) by 0 days.

(21) Appl. No.: 09/720,959

(22) PCT Filed: Jul. 2, 1999

(86) PCT No.: PCT/EP99/04602

§ 371 (c)(1),
(2), (4) Date: Jan. 3, 2001

(87) PCT Pub. No.: WO00/03079

PCT Pub. Date: Jan. 20, 2000

(30) Foreign Application Priority Data

Jul. 8, 1998 (CH) ..... 1460/98

(51) Int. Cl.[7] ..... G01D 11/00
(52) U.S. Cl. ..... 347/100; 347/101; 347/96
(58) Field of Search ..... 342/100, 101, 342/96; 106/31.48–31.53

(56) References Cited

U.S. PATENT DOCUMENTS

| | | | | |
|---|---|---|---|---|
| 5,310,778 A | | 5/1994 | Shor et al. | 524/556 |
| 5,631,071 A | | 5/1997 | Fukunishi et al. | 442/118 |
| 6,092,890 A | * | 7/2000 | Wen et al. | 347/101 |

FOREIGN PATENT DOCUMENTS

| | | | | |
|---|---|---|---|---|
| DE | 4328215 | | 3/1994 | |
| DE | 19727767 | | 1/1999 | |
| EP | 0177111 | * | 4/1986 | B41M/1/36 |
| EP | 0655527 | | 5/1995 | |
| WO | 98/20084 | | 5/1998 | |

OTHER PUBLICATIONS

Derwent Abstr. 1999–071789 for DE 19727767 (1999).
Derwent Abstr. 87–317660 for JP 62225577 (1987).
Derwent Abstr. 87–247062 for JP 62169875 (1987).
Patent Abstracts of Japan Publication No. 56157470 (1981).

* cited by examiner

*Primary Examiner*—John Barlow
*Assistant Examiner*—Manish S. Shah
(74) *Attorney, Agent, or Firm*—Kevin T. Mansfield

(57) ABSTRACT

A method for printing fibrous textile materials according to the ink-jet printing technique, which method includes printing the fibrous materials with an aqueous ink including a) a pigment dye b) a water-dispersible or water-soluble mixture of pigment dye binders wherein one component of the mixture is based on the polymerization product of acrylic acid and another component of the mixture is based on the polymerization product of acrylic acid and urethane, and c) glycerol, propylene glycol or diethylene glycol.

10 Claims, No Drawings

METHOD FOR PRINTING FIBROUS TEXTILE MATERIALS ACCORDING TO THE INK JET PRINTING TECHNIQUE

The present invention relates to a method for printing fibrous textile materials according to the ink-jet printing technique.

Ink-jet printing processes have been used in the textile industry for some years. Such processes make it possible to dispense with the otherwise customary production of a printing screen, so that considerable savings can be made in terms of cost and time. Especially in the case of the production of pattern originals it is possible to respond to a change in requirements within a significantly shorter period of time.

Such ink-jet printing processes should especially have optimum characteristics from the standpoint of application technology. In this connection mention may be made of characteristics such as the viscosity, stability, surface-tension and conductivity of the inks used. Furthermore, higher demands are being made of the quality of the resulting prints, e.g. in respect of colour strength and fastness to wetting. Those demands are not met by the known processes in all characteristics, so that there is still a need for new processes for the ink-jet printing of textiles.

The invention relates to a process for printing fibrous textile materials according to the ink-jet printing technique, wherein the fibrous materials are printed with an aqueous ink comprising a pigment dye together with a water-dispersible or water-soluble pigment dye binder.

Suitable pigment dyes for the process according to the invention include both inorganic pigments, e.g. carbon black, titanium dioxide and iron oxides, and organic pigments, especially those of the phthalocyanine, anthraquinone, perinone, indigoid, thioindigoid, dioxazine, diketopyrrolopyrrole, isoindolinone, perylene, azo, quinacridone and metal complex series, for example metal complexes of azo, azomethine or methine dyes, and also classic azo dyes of the β-oxynaphthoic acid and acetoacetarylide series or metal salts of azo dyes. It is also possible to use mixtures of different organic pigments or mixtures of one or more inorganic pigments with one or more organic pigments. Examples of such pigment dyes are listed under "Pigments" in the Colour Index, 3rd edition (3rd revision 1987 inclusive Additions and Amendments up to No. 85). Pigment dyes of the monoazo, disazo, phthalocyanine and anthraquinone series and also inorganic pigment dyes, such as carbon black and iron oxides, are of special interest.

Especially preferred pigment dyes are dyes of formula (1)

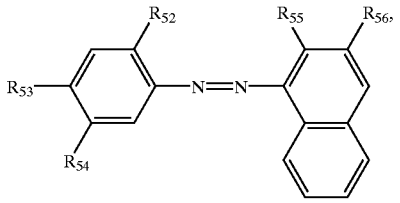

wherein $R_{52}$ is hydrogen, halogen, $C_1$–$C_4$alkyl, $C_1$–$C_4$alkoxy, nitro or cyano, $R_{53}$ is hydrogen, halogen, nitro or cyano, $R_{54}$ is hydrogen, halogen or phenylaminocarbonyl, $R_{55}$ is hydrogen or hydroxy, and $R_{56}$ is hydrogen or a radical of formula

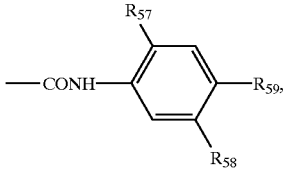

wherein $R_{57}$ is hydrogen, $C_1$–$C_4$alkyl or $C_1$–$C_4$alkoxy, $R_{58}$ is hydrogen, $C_1$–$C_4$alkoxy or halogen, and $R_{59}$ is hydrogen, $C_1$–$C_4$alkyl, $C_1$–$C_4$alkoxy or halogen, and dyes of formula (2)

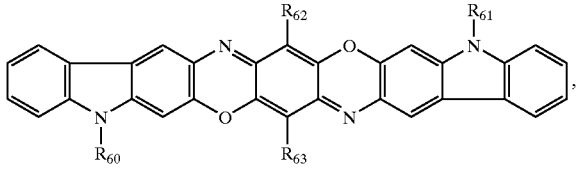

wherein $R_{60}$ and $R_{61}$ are each independently of the other $C_1$–$C_4$alkyl and $R_{62}$ and $R_{63}$ are halogen, and dyes of formula (3)

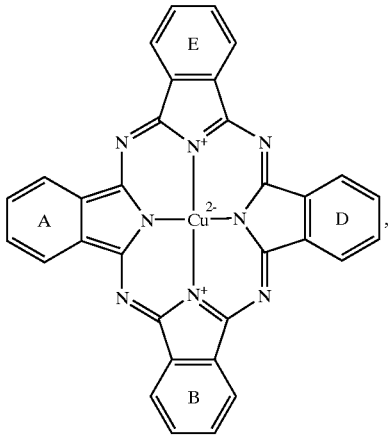

wherein the rings A, B, D and E are unsubstituted or mono- or poly-substituted by halogen, and dyes of formula (4)

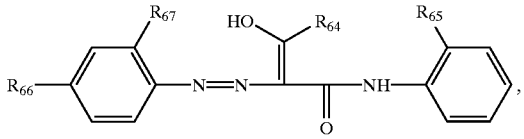

wherein $R_{64}$ is $C_1$–$C_4$alkyl, $R_{65}$ is hydrogen, halogen, $C_1$–$C_4$alkyl, $C_1$–$C_4$alkoxy, nitro or cyano, $R_{66}$ is hydrogen, halogen, nitro or cyano, $R_{67}$ is hydrogen, halogen, $C_1$–$C_4$alkyl, $C_1$–$C_4$alkoxy, nitro or cyano, and dyes of formula (5)

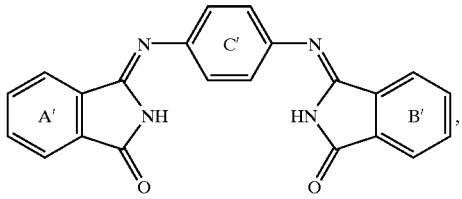

wherein the rings A' and B' are unsubstituted or mono- or poly-substituted by halogen, and dyes of formula (6)

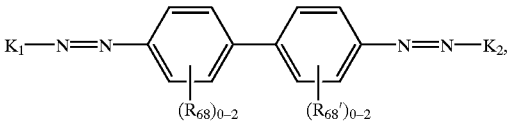

wherein $(R_{68})_{0-2}$ and $(R_{68}')_{0-2}$ each independently of the other denote from 0 to 2 substituents selected from the group halogen, $C_1$–$C_4$alkyl, $C_1$–$C_4$alkoxy, nitro and cyano, and $K_1$ and $K_2$ are each independently of the other a radical of formula

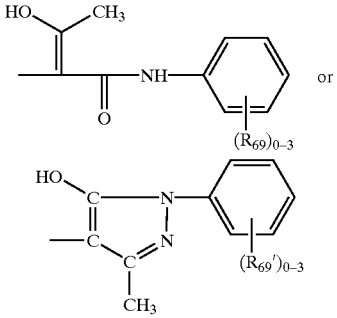

wherein $(R_{69})_{0-3}$ and $(R_{69}')_{0-3}$ each independently of the other denote from 0 to 3 substituents selected from the group halogen, $C_1$–$C_4$alkyl, $C_1$–$C_4$alkoxy, nitro and cyano, especially halogen, $C_1$–$C_4$alkyl and $C_1$–$C_4$alkoxy.

Inorganic pigment dyes, such as carbon black and iron oxides, are also of interest.

Of special interest as pigment dyes are the dyes of formulae (7a)

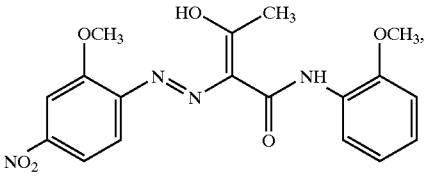

-continued (7b)

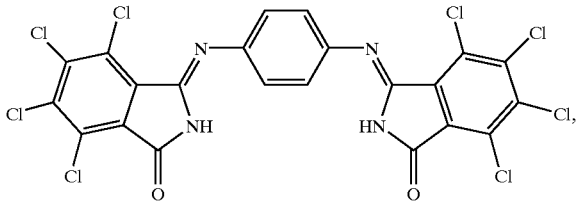

(7c)

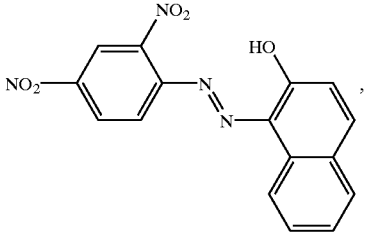

(7d)

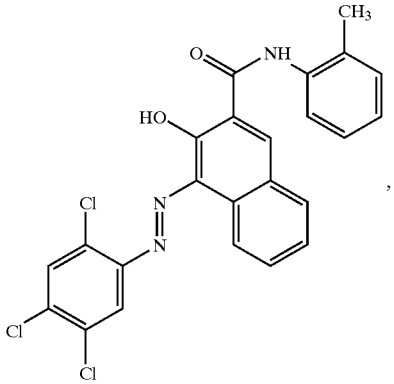

(7e)

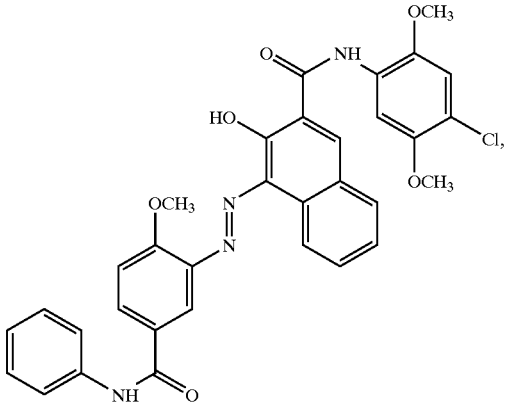

(7f)

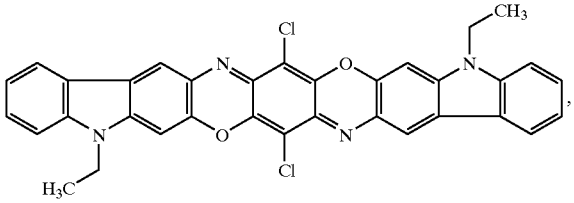

-continued (7g)

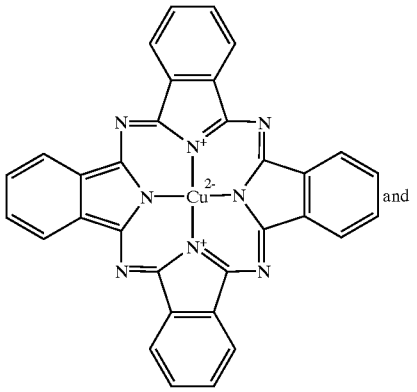

and (7h)

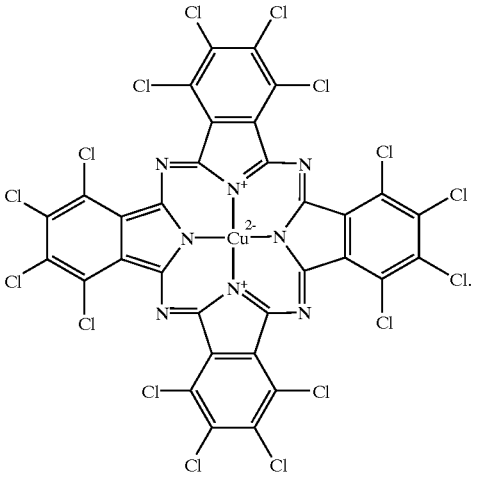

Further interesting pigment dyes are C.I. Pigment Black 7, C.I. Pigment Red 101, C.I. Pigment Yellow 17, C.I. Pigment Yellow 34, C.I. Pigment Yellow 83 and C.I. Pigment Yellow 128.

In the process according to the invention it is especially preferred to use as pigment dyes those of formulae (7e) and (7g) and also C.I. Pigment Yellow 83 and C.I. Pigment Black 7.

The mentioned pigment dyes are known or can be obtained analogously to known preparation procedures, such as diazotisation, coupling, addition and condensation reactions.

Examples of binders that come into consideration include pigment dye binders based on the polymerisation product of at least one of the components acrylic acid; other acrylic monomers, e.g. acrylic acid esters; and urethane. Preference is given to pigment dye binders based on the polymerisation product of at least one of the components acrylic acid and urethane. Of special importance are pigment dye binders based on the polymerisation product of acrylic acid; or urethane; or urethane and acrylic acid. Of special interest are mixtures of pigment dye binders wherein one component of the mixture is based on the polymerisation product of acrylic acid and another component of the mixture is based on the polymerisation product of acrylic acid and urethane. The pigment dye binders are water-dispersible or, preferably, water-soluble. Examples that may be mentioned include Carboset® 531 and Sancure® AU4010 from BFGoodrich.

In a very special embodiment of the process according to the invention, the polymerisates that come into consideration as binders do not contain sulfo or sulfato groups.

The inks preferably have a total content of dyes of from 1 to 35% by weight, especially from 1 to 30% by weight and more especially from 1 to 20% by weight, based on the total weight of the ink. As a lower limit, a limit of 2.5% by weight, especially 5% by weight and more especially 10% by weight, is preferred.

The pigment dye binder is present in the ink preferably in an amount of from 2 to 30% by weight, especially in an amount of from 5 to 20% by weight.

Preferred for the process according to the invention are those inks which have a viscosity of from 1 to 40 mPa·s (milliPascal·seconds), especially from 1 to 20 mPa·s and more especially from 1 to 10 mPa·s. Inks having a viscosity of from 2 to 5 mPa·s are of special importance. Also of importance are inks having a viscosity of from 10 to 30 mPa·s.

The inks may comprise thickeners of natural or synthetic origin, inter alia for adjusting the viscosity.

Examples of thickeners that may be mentioned include commercially available alginate thickeners, starch ethers and locust bean flour ethers. Cellulose ethers may also be mentioned.

Examples of cellulose ethers that come into consideration include methylcellulose, ethylcellulose, carboxymethylcellulose, hydroxyethylcellulose, methylhydroxyethylcellulose, hydroxypropyl cellulose and hydroxypropyl methylcellulose. Carboxymethylcellulose and hydroxypropyl methylcellulose are preferred. The cellulose ethers are preferably water-soluble. As synthetic thickeners there may also be mentioned, for example, those based on poly(meth)acrylic acids or poly(meth)acrylamides. As alginates there come into consideration especially alkali alginates and preferably sodium alginate. The thickeners are used in the ink usually in an amount of from 0.01 to 2% by weight, especially from 0.01 to 1% by weight and more especially from 0.01 to 0.5% by weight, based on the total weight of the ink. Such thickeners enable the ink to be adjusted to a specific viscosity.

As further additives, the inks may comprise surfactants, redispersants or humectants.

Suitable surfactants include commercially available anionic and non-ionic surfactants. An example of a redispersant is betaine.

The pigment dyes are advantageously used in dispersed form.

For the preparation of the dye dispersions it is possible to use the customary dispersants, preferably non-ionic dispersants.

Suitable non-ionic dispersants are especially compounds selected from the group of (ca) alkylene oxide adducts of formula (10)

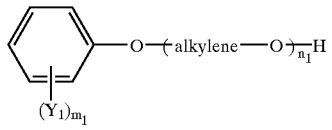

wherein $Y_1$ is $C_1$–$C_{12}$alkyl, aryl or aralkyl,

"alkylene" is the ethylene radical or propylene radical and $m_1$ is from 1 to 4 and $n_1$ is from 4 to 50, (cb) alkylene oxide adducts with (cba) saturated or unsaturated mono- to hexa-hydric aliphatic alcohols, (cbb) fatty acids, (cbc) fatty amines, (cbd) fatty amides, (cbe) diamines, (cbf) sorbitan esters, (cc) alkylene oxide condensation products (block polymerisates), (cd) polymerisates of vinylpyrrolidone, vinyl acetate or vinyl alcohol and (ce) co- or ter-polymers of vinylpyrrolidone with vinyl acetate and/or vinyl alcohol.

Suitable components (ca) are polyadducts of from 4 to 40 mol of ethylene oxide with 1 mol of a phenol that contains at least one $C_4$–$C_{12}$alkyl group, a phenyl group, a tolyl group, an a-tolylethyl group, a benzyl group, an a-methylbenzyl group or an a,a-dimethylbenzyl group, e.g. butylphenol, tributylphenol, octylphenol, nonylphenol, dinonylphenol, o-phenylphenol, benzylphenol, dibenzylphenol, a-tolylethylphenol, dibenzyl(nonyl)phenol, a-methylbenzylphenol, bis(a-methylbenzyl)phenol or tris(a-methylbenzyl)phenol, such adducts being used on their own or in admixture.

Of special interest as component (ca) are adducts of from 6 to 30 mol of ethylene oxide with 1 mol of 4-nonylphenol, with 1 mol of dinonylphenol or especially with 1 mol of compounds prepared by addition of from 1 to 3 mol of styrenes to 1 mol of phenols.

The preparation of the styrene addition products is carried out in known manner, preferably in the presence of catalysts, such as sulfuric acid, p-toluenesulfonic acid or especially zinc chloride. As styrenes there come into consideration advantageously styrene, a-methylstyrene and vinyltoluene (4-methylstyrene). Examples of the phenols are phenol, cresols and xylenols.

Very especially preferred are ethylene oxide adducts of formula (21)

(11)

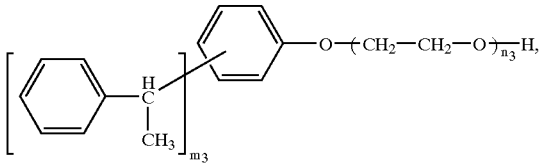

wherein $m_3$ is from 1 to 3 and $n_3$ is from 8 to 30.

Also preferred are ethylene oxide adducts of formula (12)

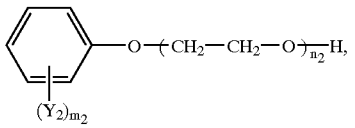

wherein $Y_2$ is $C_4$–$C_{12}$alkyl, phenyl, tolyl, tolyl-$C_1$–$C_3$alkyl or phenyl-$C_1$–$C_3$alkyl, e.g. a-methyl- or a,a-dimethylbenzyl, and $m_2$ is from 1 to 3 and $n_2$ is from 4 to 40.

The non-ionic component (cb) is advantageously an alkylene oxide addition product of from 1 to 100 mol of alkylene oxide, e.g. ethylene oxide and/or propylene oxide, with 1 mol of an aliphatic monoalcohol having at least 4 carbon atoms, of a tri- to hexa-hydric aliphatic alcohol or of a phenol unsubstituted or substituted by alkyl, phenyl, a-tolylethyl, benzyl, a-methylbenzyl or by a,a-dimethylbenzyl (cba);

an alkylene oxide addition product of from 1 to 100 mol, preferably from 2 to 80 mol, of ethylene oxide (wherein individual ethylene oxide units may have been replaced by substituted epoxides, such as styrene oxide and/or propylene oxide) with higher unsaturated or saturated monoalcohols (cba), fatty acids (cbb), fatty amines (cbc) or fatty amides (cbd) having from 8 to 22 carbon atoms;

an alkylene oxide addition product, preferably an ethylene oxide/propylene oxide adduct with ethylenediamine (cbe);

an ethoxylated sorbitan ester having long-chain ester groups, e.g. polyoxyethylene sorbitan monolaurate having from 4 to 20 ethylene oxide units or polyoxyethylene sorbitan trioleate having from 4 to 20 ethylene oxide units (cbf).

Preferred components (cc) are ethylene oxide adducts with polypropylene oxide (so-called EO-PO block polymers) and propylene oxide adducts with polyethylene oxide (so-called reverse EO-PO block polymers).

Special preference is given to ethylene oxide/propylene oxide block polymers wherein the molecular weight of the polypropylene oxide base is from 1700 to 4000 and the ethylene oxide content in the total molecule is from 30 to 80%, especially from 60 to 80%.

Also of interest are dispersants based on naphthalene-sulfonates.

It is especially preferable for the inks to comprise humectants, usually in an amount of from 2 to 30% by weight, especially from 5 to 30% by weight and more especially from 5 to 25% by weight, based on the total weight of the ink. As humectants there come into consideration especially polyhydric alcohols, such as ethylene glycol, diethylene glycol, triethylene glycol, tetraethylene glycol, propylene glycol, dipropylene glycol, glycerol and polyethylene glycols having a molecular weight of preferably from 200 to 800. Of special interest are glycerol, propylene glycol and diethylene glycol. Propylene glycol or a mixture of diethylene glycol and glycerol, e.g. in a ratio by weight of from 10:1 to 1:10, preferably from 5:1 to 1:5 and especially from 3:1 to 1:3, are of very special interest.

If desired, the inks may also comprise acid donors, such as butyrolactone or sodium hydrogen phosphate, preservatives, substances that inhibit the growth of fungi and/or bacteria, antifoams, wetting agents, sequestering agents, emulsifiers, water-insoluble solvents, oxidising agents or air-releasing agents.

As preservatives there come into consideration especially formaldehyde-yielding agents, e.g. paraformaldehyde and trioxane, more especially aqueous, approximately 30 to 40% by weight formaldehyde solutions; as sequestering agents, for example, nitrilotriacetic acid sodium salt, ethylenediaminetetraacetic acid sodium salt, especially sodium polymetaphosphate, more especially sodium hexametaphosphate; as emulsifiers especially adducts of an alkylene oxide and a fatty alcohol, more especially an adduct of oleyl alcohol and ethylene oxide; as water-insoluble solvents high-boiling, saturated hydrocarbons, especially paraffins having a boiling range of approximately from 160 to 210° C. (so-called white spirits); as oxidising agents, for example, an aromatic nitro compound, especially an aromatic mono- or di-nitro-carboxylic acid or -sulfonic acid, which is optionally in the form of an alkylene oxide adduct, especially a nitrobenzenesulfonic acid; and as air-releasing agents, for example, high-boiling solvents, especially oils of turpentine, higher alcohols, preferably $C_8$- to $C_{10}$-alcohols, terpene alcohols, and air-releasing agents based on mineral oils and/or silicone oils, especially commercial formulations of approximately from 15 to 25% by weight of a mineral oil and silicone oil mixture and approximately from 75 to 85% by weight of a $C_8$alcohol, such as 2-ethyl-n-hexanol. These are normally used in amounts of from 0.01 to 5% by weight, especially from 0.01 to 5% by weight, based on the total weight of the ink.

As further constituents of the ink there may be mentioned chemicals, such as alkali, for example in amounts of from 0.1 to 5% by weight, especially from 0.5 to 2% by weight. Examples of such chemicals include aqueous ammoniacal solutions and also dimethylethanolamine.

In a preferred embodiment of the process according to the invention, the ink comprises a) a pigment dye of formula (1), (2), (3), (4), (5) or (6) or inorganic pigment dyes based on carbon black or iron oxides, b) a water-dispersible or water-soluble pigment dye binder based on the polymerisation product of at least one of the components acrylic acid and urethane, and c) glycerol, propylene glycol or diethylene glycol.

The inks can be prepared in the manner customary for pigment dyes by mixing the individual constituents together in the desired amount of water. In the finished ink, the pigment particles preferably have a defined size range and especially should not exceed a specific particle size, for example 10 $\mu$m, especially 5 $\mu$m. The pigment particles preferably have an average particle size of 1 $\mu$m or less. A defined particle size range can be obtained, for example, when the pigments are ground wet and the particle size range is monitored continuously by laser particle-size analysis.

The process for printing fibrous textile materials according to the invention can be carried out using ink-jet printers suitable for textile printing that are known per se.

In ink-jet printing, individual droplets of the ink are sprayed onto a substrate in a controlled manner from a nozzle. For this purpose, predominantly the continuous ink-jet method and the drop-on-demand method are used. In the continuous ink-jet method, the droplets are produced continuously and any droplets not required for the printing are conveyed to a collecting vessel and recycled, whereas in the drop-on-demand method droplets are produced and printed as required; that is to say droplets are produced only when required for the printing. The production of the droplets can be effected, for example, by means of a piezo ink-jet head. For the process according to the invention, printing in accordance with the continuous ink-jet method is preferred.

Fibrous textile materials that come into consideration are especially hydroxyl-group-containing fibrous materials. Preference is given to fibrous cellulosic materials that consist wholly or partly of cellulose. Examples are natural fibrous materials, such as cotton, linen and hemp, and regenerated fibrous materials, for example viscose and lyocell. Special preference is given to viscose and especially cotton. Further fibrous materials include wool, silk, polyvinyl, polyacrylonitrile, polyamide, aramide, polypropylene and polyurethane. The said fibrous materials are preferably in the form of sheet-form textile woven fabrics, knitted fabrics or webs.

After printing, the fibrous material is advantageously dried, preferably at temperatures of up to 150° C., especially from 80 to 120° C., and then the print is fixed.

The print can be fixed, for example, by means of a heat treatment, which is preferably carried out at a temperature of from 120 to 190° C., the fixing preferably taking from 1 to 8 minutes.

The fixing can, however, also be carried out using ionising radiation or by irradiation with UV light.

The printed or dyed fibrous material is advantageously irradiated and fixed at elevated temperature, e.g. from 40 to 120° C., especially from 60 to 100° C. The irradiation can take place immediately after the drying operation or alternatively the cold printed fibrous material can be heated to the desired temperature, e.g. in an infra-red heating apparatus, prior to the irradiation.

Ionising radiation is to be understood as being radiation that can be detected using an ionisation chamber. It either consists of electrically charged, directly ionising particles that, in gases, generate ions along their path as a result of collisions or it consists of uncharged, indirectly ionising particles or photons that, in matter, generate directly ionising charged secondary particles, such as the secondary electrons of X-rays or $\gamma$-rays or the recoil nuclei (especially protons) of fast neutrons; indirectly ionising particles also include slow neutrons that, by means of nuclear reactions, are able to generate high-energy charged particles partly directly and partly by way of photons from ($\beta$,$\gamma$)-processes. Heavy charged particles include protons, atomic nuclei and ionised atoms. Of special importance for the process according to the invention are light charged particles, e.g. electrons. X-ray radiation includes both bremsstrahlung and characteristic radiation. Important particle radiation of heavy charged particles includes $\alpha$-radiation.

The generation of ionising radiation can be effected in accordance with one of the customary methods. For example, spontaneous nuclear transformations and also nuclear reactions (forced nuclear transformations) can be used for the generation. Radiation sources accordingly include natural and artificial radioactive substances and especially atomic reactors. The radioactive fission products produced in such reactors as a result of nuclear fission represent a further important radiation source.

A further method that comes into consideration is the generation of radiation by means of an X-ray tube.

Of special importance are rays that consist of particles accelerated in electric fields. Radiation sources that come into consideration here include thermal, electron impact, low voltage arc, cold cathode and high frequency ion sources. Electron beams are of special importance for the process of the present invention. They are generated by accelerating and focussing electrons emitted from a cathode by thermionic, field or photo emission and by electron or ion bombardment. Beam sources are electron guns and accelerators of customary structure. Examples of beam sources are known from the literature, for example International Journal of Electron Beam & Gamma Radiation Processing, especially 1/89 pages 11–15; Optik, 77 (1987), pages 99–104.

Sources of rays for electron beams also include $\beta$-emitters, for example strontium 90.

Ionising rays that can advantageously be used industrially also include $\gamma$-rays, which are readily generated especially with caesium 137 or cobalt 60 isotope sources.

Fixing by means of ionising radiation is generally carried out by passing a fibrous textile material that has been printed and dried in accordance with the invention through the beam of an electron accelerator at temperatures of from 60 to 100° C. This takes place at a speed sufficient to achieve a certain dose of radiation. The doses of radiation normally to be used are from 0.1 to 15 Mrad at an accelerator voltage of from 160 to 300 kV, the dose of radiation advantageously being from 0.1 to 4 Mrad. At a dose of less than 0.1 Mrad, the degree of fixing is generally too low, while a dose of more than 15 Mrad frequently results in damage to the fibrous material and to the dye. It will be understood that when the fixing is carried out by means of ionising radiation attention must be paid to the appropriate technical requirements. For example, the specific embodiment will be governed especially by the nature of the ionising rays to be used and the manner in which they are generated. For example, if the printed fibrous material is to be irradiated with γ-rays, it will be exposed to the radiation enclosed in a cell. If, when a low beam intensity is used, higher doses of radiation are desired, the material to be irradiated can be exposed to the radiation in a plurality of passes.

When ultraviolet radiation is used, the presence of a photoinitiator is generally necessary. The photoinitiator absorbs the radiation in order to produce free radicals that initiate the polymerisation. Examples of photoinitiators and photoinitiators used according to the invention include carbonyl compounds, such as 2,3-hexanedione, diacetylacetophenone, benzoin and benzoin ethers, such as dimethyl, ethyl and butyl derivatives, e.g. 2,2-diethoxyacetophenone and 2,2-dimethoxyacetophenone, benzophenone or a benzophenone salt, and phenyl-(1-hydroxycyclohexyl)-ketone or a ketone of formula

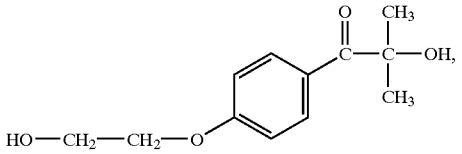

benzophenone in combination with a catalyst such as triethylamine, N,N'-dibenzylamine and dimethylaminoethanol and benzophenone plus Michler's ketone; acylphosphine oxides; nitrogen-containing compounds, such as diazomethane, azo-bis-isobutyronitrile, hydrazine, phenylhydrazine and trimethylbenzylammonium chloride; and sulfur-containing compounds, such as benzenesulfonate, diphenyl disulfide and also tetramethylthiuram disulfide, as well as phosphorus-containing compounds, e.g. phosphine oxides. Such photoinitiators are used on their own or in combination with one another.

The proportion of photoinitiators in the applied dye components, immediately before irradiation, is from 0.01 to 20%, preferably from 0.1 to 5%, based on the total amount of colourless polymerisable compounds used.

Both water-soluble and water-insoluble photoinitiators are suitable. In addition, copolymerisable photoinitiators, such as those mentioned, for example, in "Polymers Paint Colour Journal", 180, page 42f (1990), are especially advantageous.

Also suitable are cationic photoinitiators, such as triarylsulfonium salts, diaryliodonium salts, diaryl-iron complexes or generally structures such as those described in "Chemistry & Technology of UV & EB Formulation for Coatings, Inks & Paints" Vol. 3, published by SITA Technology Ltd., Gardiner House, Broomhill Road, London, 1991.

Preference is given to the use of acylphosphine oxides, e.g. (2,4,6-trimethylbenzoyl)-(diphenyl)phosphine oxide, or photoinitiators of formula

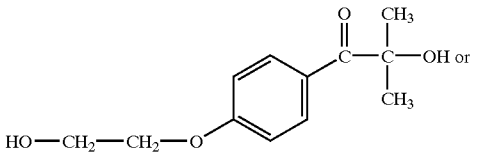

-continued

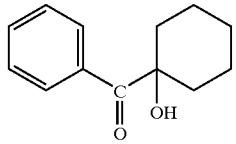

or to the use of a photoinitiator of formula

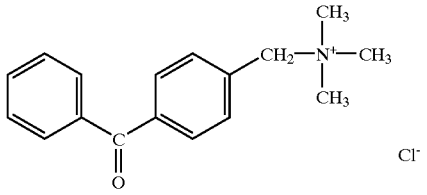

together with a photoinitiator of the two formulae mentioned above or with a photoinitiator of formula

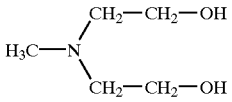

or benzophenone together with a photoinitiator of the above three formulae.

Very special preference is given to the use of the following photoinitiators:

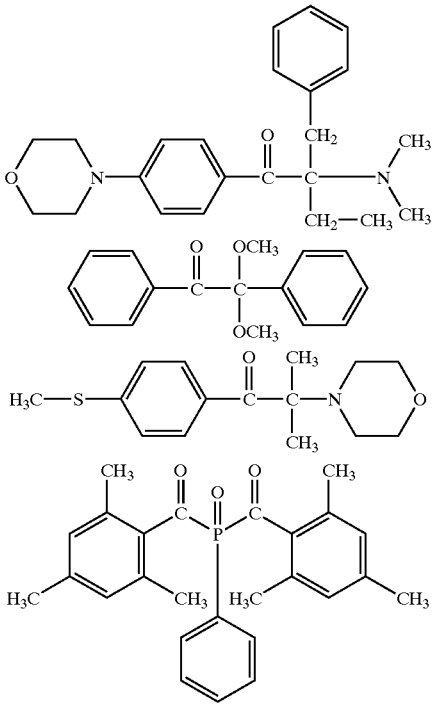

and a mixture of the compounds of formulae

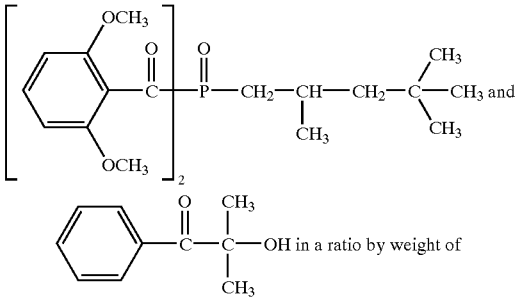

from 50:50 to 10:90,
and a mixture of the compound of formula

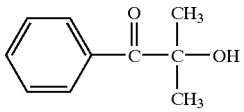

and 2,4,6-trimethylbenzoyldiphenylphosphine in a ratio by weight of from 20:80 to 60:40.

The UV light to be used is radiation the emission of which is at from 200 to 450 nm, especially from 210 to 400 nm. The radiation is preferably generated artificially using high pressure, medium pressure or low pressure mercury vapour lamps, halogen lamps, metal halide, xenon or tungsten lamps, carbon arc lamps or fluorescent lamps, H- and D-lamps, superactinic fluorescent tubes and lasers.

It is advantageous to use capillary high pressure mercury lamps or high pressure mercury lamps or low pressure mercury lamps.

It is particularly advantageous to use high pressure mercury lamps and medium pressure mercury lamps, which may also have been doped, for example, with iron or gallium halide. Such lamps may also be excited with microwaves or operated in pulses in order to concentrate the radiation in peaks. In the case of xenon lamps too, pulsed operation is possible when a higher proportion of longer wavelength UV light is required.

In general, the customary UV radiation sources, as described in "Chemistry & Technology of UV & EB Formulation for Coatings, Inks & Paints", Volume 1, published by SITA Technology, Gardiner House, Broomhill Road, London, 1991, are suitable.

The exact period of time for which the prints are irradiated is governed by the luminosity of the UV source, the distance from the light source, the nature and amount of photoinitiator and the permeability of the formulation and the textile substrate to UV light.

Customary periods of irradiation with UV light are from 1 second to 20 minutes, preferably from 5 seconds to 2 minutes. The fixing can be terminated by interrupting the light radiation, so that fixing can also be carried out discontinuously.

The irradiation can be carried out in the atmosphere of an inert protective gas, for example under nitrogen, in order to prevent inhibition by oxygen. Oxygen inhibition can also be suppressed effectively by the addition of so-called "anti-blocking agents", that is to say amines and especially also aminoacrylates.

After the fixing, the printed fibrous material can be washed off and dried in customary manner.

Both the ink-jet printing and the subsequent drying and the fixing can also be carried out in a single step, which means, especially, that those steps are carried out continuously, that is to say apparatuses for the ink-jet printing, the drying and the fixing are mounted one after another and the fibrous material to be printed is moved through them continuously. The apparatuses for the ink-jet printing, the drying and the fixing can also be combined in a single machine. The fibrous material is transported continuously through the machine and is thus in the finished state when it leaves the machine. The drying can be effected, for example, by means of thermal energy (e.g. as indicated above) or especially by means of infra-red radiation (IR). The fixing can here be effected e.g. as indicated above. It will be understood that the ink-jet printing can also be carried out separately and the drying and fixing performed continuously as indicated above, e.g. in a single machine.

Using the printing processes indicated above it is possible to print the fibrous materials either in a single shade or in a variety of shades. When the printing is in one shade, the fibrous material can be printed over the entire surface or with a pattern. For that purpose, of course, the use of a single ink is sufficient, but the desired shade can also be created by printing with a plurality of inks of different shades. If the fibrous material is to receive a print having a plurality of different shades, the fibrous material can either be printed with a plurality of inks each having the desired shade or it can be printed in such a manner that the shade in question is created (e.g. by printing the fibrous material with inks of different shades one on top of another, thus producing the required shade).

It is also possible to print a sheet-form fibrous material on both sides. In that case, for example, one side of the fibrous material can be printed in one shade, e.g. over the entire surface, and the other side of the fibrous material printed with a pattern in one or more different shades. It will be understood that, in principle, that other side can likewise be printed in one shade over its entire surface. Such a process can be carried out, for example, by having one or more print heads arranged on each side of the sheet-form fibrous material to be printed. Both sides of the fibrous material can thus be printed simultaneously. The print heads on each side of the fibrous material can be arranged either directly opposite one another or laterally displaced with respect to one another. The fibrous material is usually moved along between the print heads. Using this embodiment it is possible to obtain interesting effects, which are visible especially when the sheet-form fibrous material is folded over.

A further interesting embodiment relates to so-called "imaging", in which an original, that is to say an image that is to be reproduced by the print, is digitised, for example by means of a video camera or a scanner. The digitised image is transferred to a computer, which then prints the image onto the fibrous material by means of an ink-jet printer. Of course, the digitised image may already be stored in the computer, so that digitisation is unnecessary. For example, an image to be printed may have already been created on the computer using graphics software. The image to be printed may also include, for example, letters, numbers, words, all kinds of patterns and also complex multi-coloured images. Multi-coloured images can be created, for example, by using a plurality of inks of different shades.

The prints obtainable in accordance with the process of the invention have good all-round properties; for example, they exhibit good fastness to light, good wet-fastness properties, such as fastness to water, to washing, to seawater, to crossdyeing and to perspiration, good fastness to chlorine, fastness to rubbing, fastness to hot pressing and fastness to pleating, as well as sharp outlines and high colour strength. The printing inks used are distinguished by good stability and good viscosity characteristics.

The following Examples serve to illustrate the invention. Unless otherwise indicated, the temperatures are given in degrees Celsius, parts are parts by weight and percentages relate to percent by weight. Parts by weight relate to parts by volume in a ratio of kilograms to liters.

EXAMPLE 1

A cotton fabric is printed with an aqueous ink A, containing

5% by weight pigment dye of formula

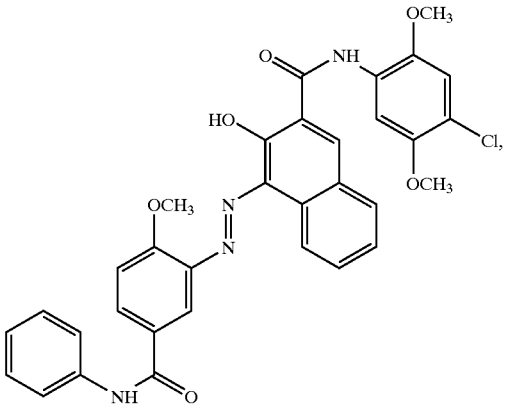

10% by weight commercially available polyacrylate binder in water-dispersed form (Carboset® 531), 15% by weight diethylene glycol, 5% by weight glycerol, and 65% by weight water, using a drop-on-demand piezo ink-jet head. The print is dried completely and then fixed for 90 seconds at 190° C. The print obtained has good all-round properties.

EXAMPLES 2 TO 8

By proceeding as indicated in Example 1, but using instead of 5% by weight of the pigment dye indicated therein the same amount of one of the pigment dyes indicated in Table 1 below, there are likewise obtained prints having good all-round properties.

TABLE 1

| Ex. | Dye |
|---|---|
| 2 | 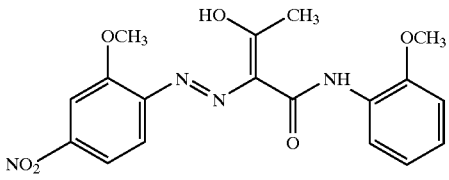 |
| 3 | 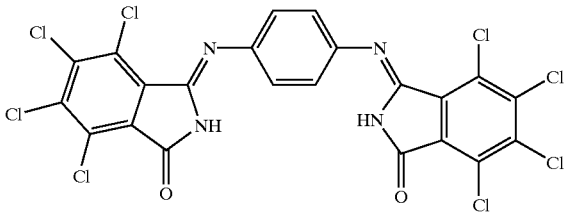 |
| 4 | 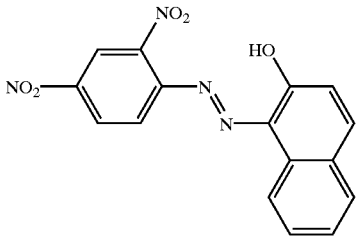 |

TABLE 1-continued
| Ex. | Dye |
|---|---|
| 5 | 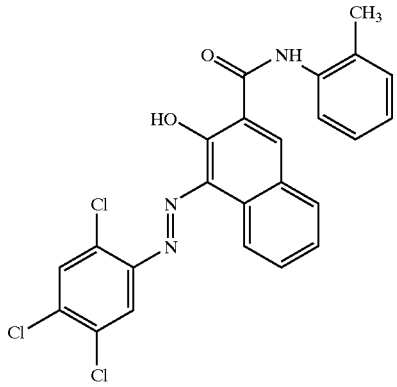 |
| 6 | 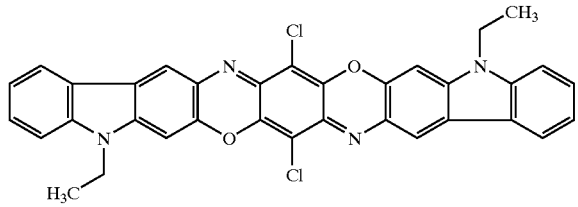 |
| 7 | 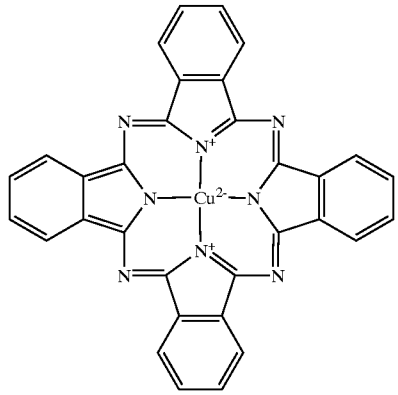 |
| 8 | 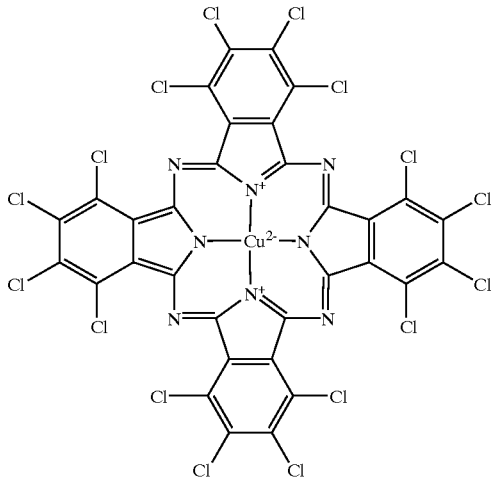 |

By proceeding as in Example 1, but using instead of 5% by weight of the pigment dye indicated therein the same amount of the pigment dye C.I. Pigment Black 7, C.I. Pigment Red 101, C.I. Pigment Yellow 17, C.I. Pigment Yellow 34, C.I. Pigment Yellow 83 or C.I. Pigment Yellow 128, there are likewise obtained prints having good all-round properties.

EXAMPLE 9

A cotton fabric is printed with an aqueous ink A, containing

5% by weight pigment dye of formula

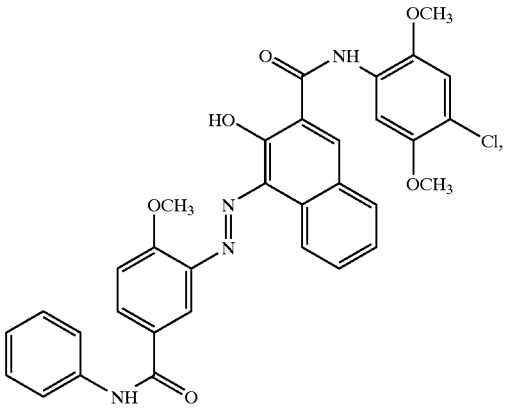

10% by weight commercially available polyacrylate binder in water-dispersed form (Carboset® 531), 15% by weight diethylene glycol, 5% by weight glycerol, 2% by weight dispersant based on napthalenesulfonate, 1% by weight aqueous ammoniacal solution (30%) and 62% by weight water, using a drop-on-demand piezo ink-jet head. The print is dried completely and then fixed for 90 seconds at 190° C. The print obtained has good all-round properties.

EXAMPLE 10

A cotton fabric is printed with an aqueous ink A, containing

5% by weight pigment dye of formula

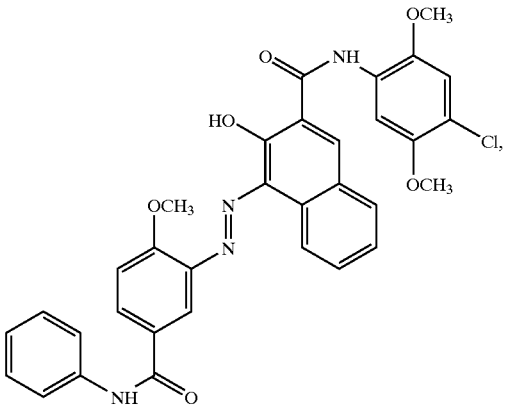

10% by weight commercially available polyacrylate binder in water-dispersed form (Carbosett® 531), 2% by weight commercially available polyurethane acrylate binder in water-dispersed form (Sancure® AU-4010), 15% by weight diethylene glycol, 5% by weight glycerol, 2% by weight commercially available defoamer, and 61% by weight water, using a drop-on-demand piezo ink-jet head. The print is dried completely and then fixed for 90 seconds at 190° C. The print obtained has good all-round properties.

We claim:

1. A process for printing fibrous textile materials according to the ink-jet printing technique, which process comprises printing the fibrous materials with an aqueous ink comprising a) a pigment dye of formula (1)

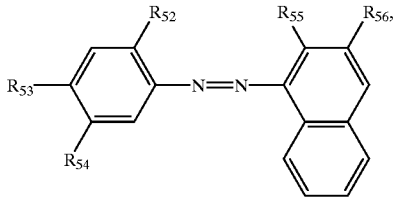

wherein $R_{52}$ is hydrogen, halogen, $C_1$–$C_4$alkyl, $C_1$–$C_4$alkoxy, nitro or cyano, $R_{53}$ is hydrogen, halogen, nitro or cyano, $R_{54}$ is hydrogen, halogen or phenylaminocarbonyl, $R_{55}$ is hydrogen or hydroxy, and $R_{56}$ is hydrogen or a radical of formula

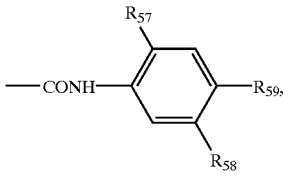

wherein $R_{57}$ is hydrogen, $C_1$–$C_4$alkyl or $C_1$–$C_4$alkoxy, $R_{58}$ is hydrogen, $C_1$–$C_4$alkoxy or halogen, and $R_{59}$ is hydrogen, $C_1$–$C_4$alkyl, $C_1$–$C_4$alkoxy or halogen, (2)

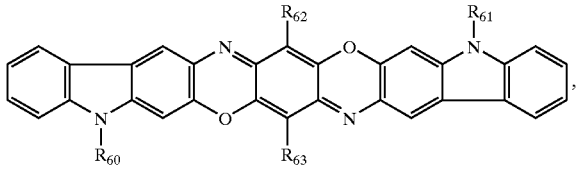

wherein $R_{60}$ and $R_{61}$ are each independently of the other $C_1$–$C_4$alkyl and $R_{62}$ and $R_{63}$ are halogen, (3)

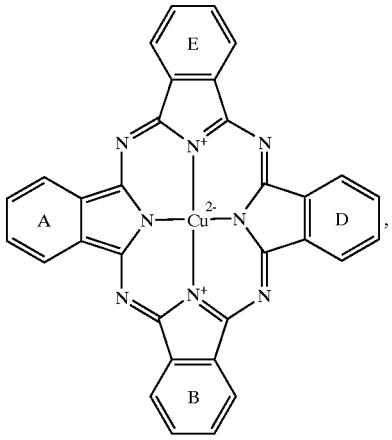

wherein the rings A, B, D and E are unsubstituted or mono- or poly-substituted by halogen, (4)

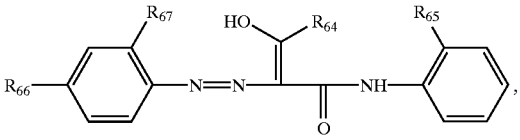

wherein $R_{64}$ is $C_1$–$C_4$alkyl, $R_{65}$ is hydrogen, halogen, $C_1$–$C_4$alkyl, $C_1$–$C_4$alkoxy, nitro or cyano, $R_{66}$ is hydrogen, halogen, nitro or cyano, $R_{67}$ is hydrogen, halogen, $C_1$–$C_4$alkyl, $C_1$–$C_4$alkoxy, nitro or cyano, (5)

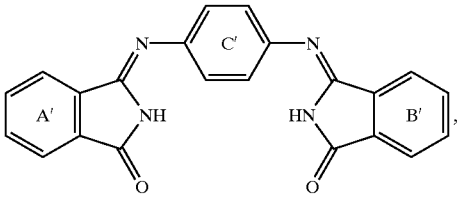

wherein the rings A' and B' are unsubstituted or mono- or poly-substituted by halogen, (6)

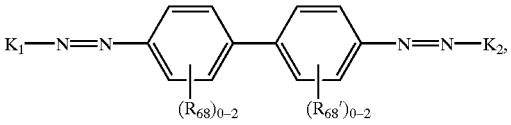

wherein in $(R_{68})_{0-2}$and $(R_{68'})_{0-2}$ each independently of the other denote from 0 to 2 substituents selected from the group halogen, $C_1$–$C_4$alkyl, $C_1$–$C_4$alkoxy, nitro and cyano, and $K_1$ and $K_2$ are each independently of the other a radical of formula

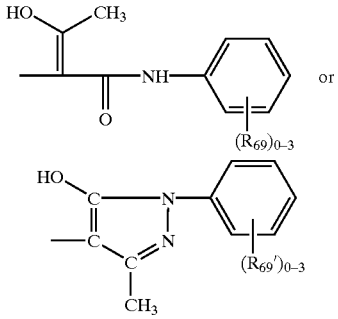

wherein $(R_{69})_{0-3}$ and $(R_{69'})_{0-3}$ each independently of the other denote from 0 to 3 substituents select group halogen, $C_1$–$C_4$alkyl, $C_1$–$C_4$alkoxy, nitro and cyano, especially halogen, $C_1$–$C_4$alkyl and $C_1$–$C_4$alkoxy, or inorganic pigment dyes based on carbon black or iron oxides, b) a water-dispersible or water-soluble mixture of pigment dye binders wherein one component of the mixture is based on the polymerisation product of acrylic acid and another component of the mixture is based on the polymerisation product of acrylic acid and urethane, and c) glycerol, propylene glycol or diethylene glycol.

2. A process according to claim 1, wherein there is used an ink having a total content of dyes of from 1 to 35% by weight based on the total weight of the ink.

3. A process according to claim 1, wherein there is used an ink that, based on the total weight of the ink, contains from 2 to 30% by weight glycerol, propylene glycol or diethylene glycol.

4. A process according to claim 1, wherein there is used an ink that, based on the total weight of the ink, contains from 2 to 30% by weight pigment dye binder.

5. A process according to claim 1, wherein the fibrous material is printed by means of a piezo ink-jet head.

6. A process according to claim 1, wherein the fibrous material used is fibrous cellulosic material.

7. A process according to claim 1, wherein, after the printing, the fibrous material is fixed at a temperature of from 120 to 190° C.

8. A process according to claim 1, wherein, after the printing, the fibrous material is fixed using ionising radiation or by irradiation with UV light.

9. A process according to claim 1, wherein, after the printing, the print is subjected to drying and fixing, the drying and fixing being carried out continuously.

10. A process according to claim 9, wherein the printing, the drying and the fixing of the print are carried out continuously.

* * * * *